US010267266B2

(12) United States Patent
Nonaka et al.

(10) Patent No.: US 10,267,266 B2
(45) Date of Patent: Apr. 23, 2019

(54) ATTACHMENT STRUCTURE FOR SOLENOID VALVE TO CARBURETOR UNIT

(71) Applicant: ZAMA JAPAN KABUSHIKI KAISHA, Iwate (JP)

(72) Inventors: Takumi Nonaka, Iwate (JP); Hideki Watanabe, Iwate (JP); Hiroyuki Oka, Takizawa-mura (JP)

(73) Assignee: ZAMA JAPAN KABUSHIKI KAISHA, Iwate (JP)

( * ) Notice: Subject to any disclaimer, the term of this patent is extended or adjusted under 35 U.S.C. 154(b) by 15 days.

(21) Appl. No.: 15/438,236

(22) Filed: Feb. 21, 2017

(65) Prior Publication Data

US 2017/0298872 A1 Oct. 19, 2017

Related U.S. Application Data

(63) Continuation of application No. 14/728,257, filed on Jun. 2, 2015, now Pat. No. 9,599,067.

(51) Int. Cl.

| | |
|---|---|
| ***F02M 7/12*** | (2006.01) |
| ***F02M 19/06*** | (2006.01) |
| ***F02M 7/18*** | (2006.01) |

(52) U.S. Cl.

CPC ..... *F02M 7/18* (2013.01); *F02M 7/12* (2013.01); *F02M 19/06* (2013.01)

(58) Field of Classification Search

CPC ..... F02M 19/06; F02M 7/12

USPC ..... 261/66, DIG. 74; 251/129.15, 129.22

See application file for complete search history.

(56) References Cited

U.S. PATENT DOCUMENTS

| | | | |
|---|---|---|---|
| 6,401,685 | B1 | 6/2002 | Warner |
| 7,131,179 | B2 | 11/2006 | Arita et al. |
| 7,264,230 | B2 | 9/2007 | Burns et al. |
| 8,382,072 | B1 | 2/2013 | Galka et al. |

FOREIGN PATENT DOCUMENTS

| | | |
|---|---|---|
| JP | 2014-105776 | 6/2014 |

*Primary Examiner* — Robert A Hopkins
(74) *Attorney, Agent, or Firm* — One LLP

(57) ABSTRACT

An attachment structure for a solenoid valve which can be stably attached to and removed from a carburetor unit with a single movement and without increasing the number of parts. A rod-like supporting portion is disposed a predetermined distance away from a surface of a carburetor unit and extending in a direction substantially perpendicular to a direction of and installed near an opening in the surface of the carburetor unit. A cylindrical engaging portion extends from a circumferential face of a cylindrical body fitted on the solenoid valve substantially perpendicular to an axial line of the rod-like supporting portion, and forms a groove-like engagement portion which is narrower in diameter than the rod-like supporting portion, whereby the engaging portion, via the groove-like engagement portion, is coupled to and supported by rod-like supporting portion when an insertion portion of the solenoid valve is inserted into the opening.

18 Claims, 6 Drawing Sheets

ATTACHMENT STRUCTURE FOR SOLENOID VALVE TO CARBURETOR UNIT

CROSS-REFERENCE TO RELATED APPLICATION

This application is a continuation of U.S. patent application Ser. No. 14/728,257, filed Jun. 2, 2015, which is incorporated herein by reference.

FIELD OF THE INVENTION

The present invention relates to an attachment structure for a solenoid valve to a carburetor unit which is inserted into an opening formed in one surface of the carburetor unit and communicating with a fuel path therein.

BACKGROUND OF THE INVENTION

Conventionally, as shown in FIG. 4, a carburetor unit 1, which is formed by aluminum die cast molding or the like, has a fuel supply path formed inside and a solenoid valve 2 inserted into an opening 12 formed in a surface 11 thereof and which communicates with the fuel supply path.

The solenoid valve 2 typically includes a hard synthetic resin cover 22 placed there over in which a connector 21 is formed as a protrusion for supplying power to a built-in solenoid and an exposed tip (insertion portion) 23 which is inserted into the opening 12. However, if inserted this way it will come out. Therefore, as shown in FIG. 5, for example, the solenoid valve 2 has been attached to the carburetor unit 1 by securing a flange portion 24 formed on the cover 2 with a bolt 13 that is screwed into the carburetor unit 1 through a bolt hole (not shown in the drawings) provided near the opening 12 in the surface 11 of the carburetor unit 1.

However, with the conventional attachment structure of the solenoid valve 2 as shown in FIG. 4, the bolt 13 is attached in an eccentric position, making it difficult to secure the solenoid valve 2 in a stable condition.

One known example of an attachment structure using attachment securing implements is presented in JP 2005-163816 A.

This attachment structure for a solenoid valve 2, as shown in FIG. 6, for example, involves attachment to the surface 11 of the carburetor unit 1 by means of an attachment screw 31 using an attachment securing implement 3 formed from metal, for example. With this attachment structure, the number of parts increases, as the attachment securing implement 3 is needed, and a bolt is also needed for the securing.

This has resulted in problems in manufacturing, since the attachment work is troublesome and the tightness of the bolt 13 has to be checked, too. The bolt 13 can come loose due to vibration over many years of use, and it is also a hassle to remove them for repair or exchange, which is a problem.

SUMMARY OF THE INVENTION

The present invention was devised to solve these issues, and to provide an attachment structure for a solenoid valve to a carburetor unit which can not only be attached to and removed from a carburetor unit stably, but can be attached and removed with a single touch and without increasing the number of parts.

The present invention, which has been devised to solve such issues, is such that a rod-like supporting portion is disposed a predetermined distance away from a surface of a carburetor unit and extending in a direction substantially perpendicular to a direction of and installed near an opening in the surface of the carburetor unit, and a cylindrical engaging portion is provided in which is formed a groove-like engagement portion that is narrower than the diameter of the rod-like supporting portion. The engaging portion extends in a direction substantially perpendicular to the axial line along which the rod-like supporting portion is inserted and supported, and is installed on an outer circumferential face of a cylindrical cover that is fitted over a main valve unit of the solenoid valve so as to expose an insertion portion in the axial direction. The rod-like supporting portion is inserted into the groove-like engagement portion when the insertion portion of the solenoid valve is inserted into the opening.

Furthermore, in the present invention, at least one of the engaging portion or the rod-like supporting portion is formed from a suitably elastic hard material, and can therefore serve for elastic engagement.

Furthermore, in the present invention the groove-like engagement portion of the engaging portion is formed substantially perpendicularly to the axial line direction of the cover, i.e., substantially perpendicular to the direction in which the solenoid valve is inserted into the opening, and therefore an advantageous effect of preventing slipping out can be expected.

In addition, the carburetor unit is a molded aluminum die cast product, a molded resin product, or another type of molded product and a holding portion which holds both ends of the rod-like supporting portion at a predetermined distance away from the surface is formed integrally with the carburetor unit, which is advantageous in terms of ease of manufacturing and strength.

In particular, the rod-like supporting portion is formed so as to be longer than the engaging portion by at least a predetermined length, and the engaging portion can be rotated in the axial direction around the supporting portion and inserted or removed, by rotating around the axial center with the insertion portion inserted into the opening, making it possible to engage and disengage with one movement.

With the present invention, not only can the solenoid valve be attached to the carburetor unit in a stable manner, but attachment and removal can be done with a single movement, without increasing the number of parts.

DESCRIPTION OF THE PREFERRED EMBODIMENTS

Next, a preferred mode for carrying out the present invention is described.

Figure 1:
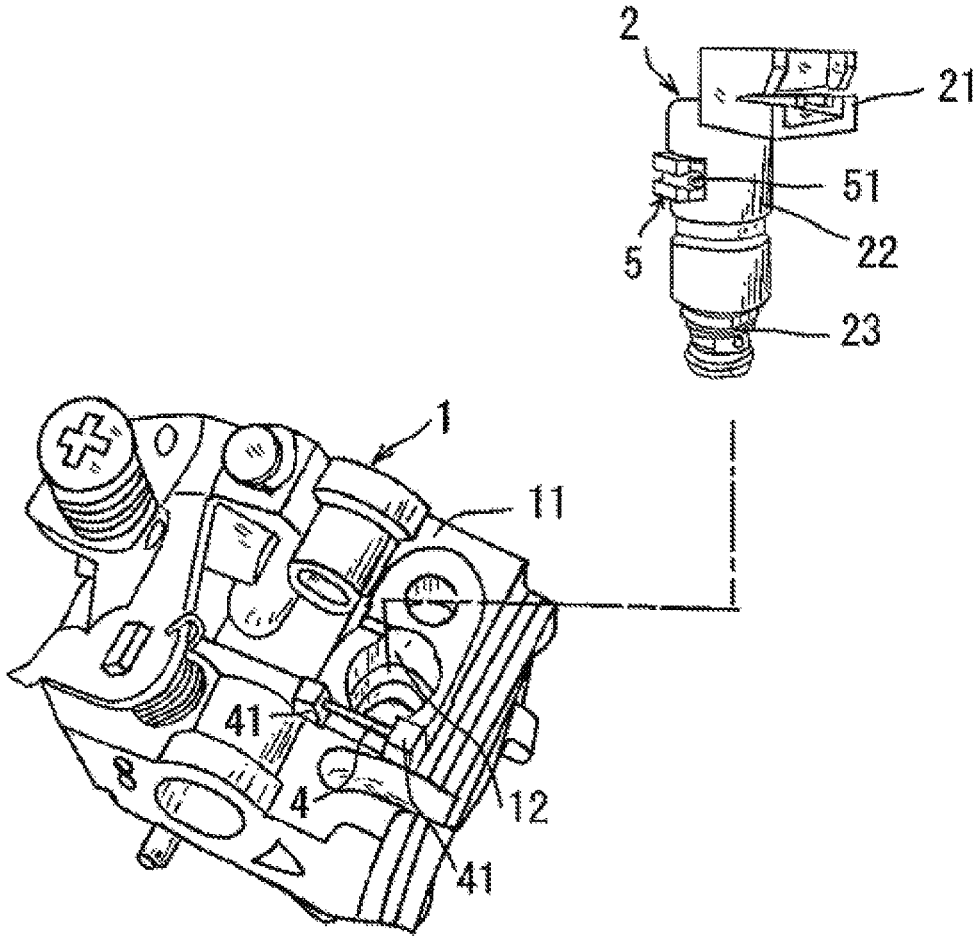
FIG. 1 is an oblique view of one embodiment of a solenoid valve of the present invention and a carburetor unit in which the solenoid valve is used.
Figure 2:
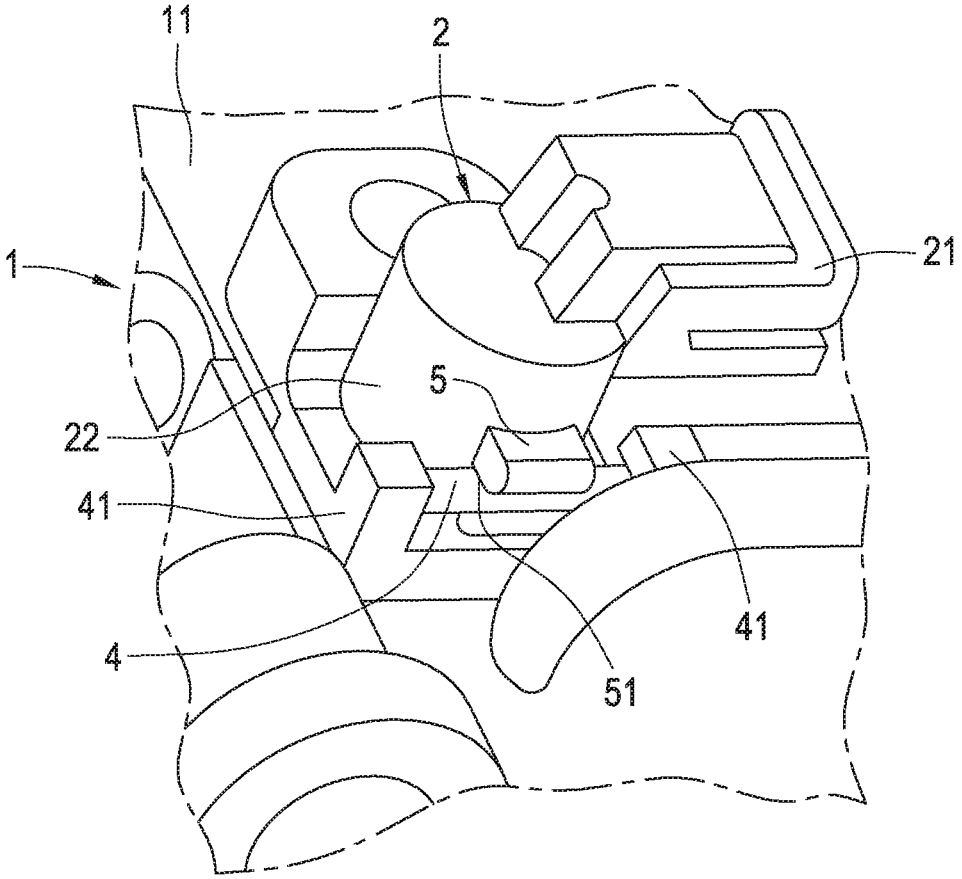
FIG. 2 is a partial oblique view showing the solenoid valve which is an embodiment shown in FIG. 1 attached to the carburetor unit.

FIG. 1 shows a preferred embodiment of a carburetor unit 1 and a solenoid valve 2 of the present invention. As with conventional solenoid valves, the solenoid valve 2 has a hard synthetic resin cover 22 in which a connector 21 is formed as a protrusion for supplying power to a built-in solenoid (not shown in the drawings), and an insertion portion 23 which is exposed at the tip.

The carburetor unit 1 of the present embodiment is formed through aluminum die cast molding or the like. An opening 12, which communicates with a fuel supply path formed inside (not shown in the drawings), is formed in a surface 11 thereof. The tip (insertion portion) 23 of the solenoid valve 2 is inserted into the opening 12.

A rod-like supporting portion 4 is disposed near the opening 12 at a predetermined distance from the surface 11 of the carburetor unit 1 and extending in a direction which is substantially perpendicular to the direction of the opening 12 in the surface 11 of the carburetor unit 1 into which the tip (insertion portion) 23 of the solenoid valve 2 is inserted.

In particular, with the present embodiment, the rod-like supporting portion 4 is supported a predetermined distance from the surface 11 of the carburetor unit 1 at both ends by protrusions 41, 41 protruding from the surface 11 of the carburetor unit 1 and opposing one another at a predetermined distance.

The solenoid valve 2 is such that the cylindrical cover 22, which is formed from a hard material having suitable elasticity, has a cylindrical engaging portion 5 which is supported on an outer circumferential surface and extending in a direction which is substantially perpendicular to the axial line along which the rod-like supporting portion 4 is inserted and supported. The cylindrical engaging portion 5 includes a groove-like engagement portion 51 which is narrower than the diameter of the rod-like supporting portion 4.

With the present embodiment, the length of the rod-like supporting portion 4 is longer than the engaging portion 5 which is fitted onto the rod-like supporting portion 4 by at least a predetermined length.

To attach the solenoid valve 2 having this configuration to the carburetor unit 1, the tip (insertion portion) 23 of the solenoid valve 2 is inserted into the opening 12 formed in the surface 11 of the carburetor unit 1, and which communicates with the fuel supply path (not shown in the drawings), and the engaging portion 5, which is formed on the cylindrical cover 22 of the solenoid valve 2, is coupled, via the groove-like engagement portion 51, to and supported by the rod-like supporting portion 4, which is supported on the surface 11 of the carburetor unit 1.

Note that the present embodiment is designed such that the distance of the rod-like supporting portion 4 from the surface 11 of the carburetor unit 1 is the same as the distance from the surface 11 of the carburetor unit 1 in the engaging portion 5 when the tip (insertion portion) 23 of the solenoid valve 2 is inserted into the opening 12. Therefore, as shown in FIG. 3, the tip (insertion portion) 23 of the solenoid valve 2 is first inserted into the opening 12 without the engaging portion 5 and the rod-like supporting portion 4 being in contact, and then the engaging portion 5 and the rod-like supporting portion 4 are fitted together along matching axial lines via the groove-like engagement portion 51 by rotating the solenoid valve 2 inside the opening 12.

Thus, with the present embodiment the solenoid valve 2 is attached solidly and simply into the carburetor unit 1 simply by inserting the solenoid valve 2 into the opening 12 of the carburetor unit 1 and fitting the engaging portion 5 and the rod-like supporting portion 4 together.

The solenoid valve 2 is such that the cylindrical cover 22, which is formed from a hard material having suitable elasticity, has a cylindrical engaging portion 5 which is supported on an outer circumferential surface and extending in a direction which is substantially perpendicular to the axial line along which the rod-like supporting portion 4 is inserted and supported. The cylindrical engaging portion 5 includes a groove-like engagement portion 51 which is narrower than the diameter of the rod-like supporting portion 4. The rod-like supporting portion 4 is supported on the surface 11 of the carburetor unit 1. Therefore, attachment is solid.

Figure 3:
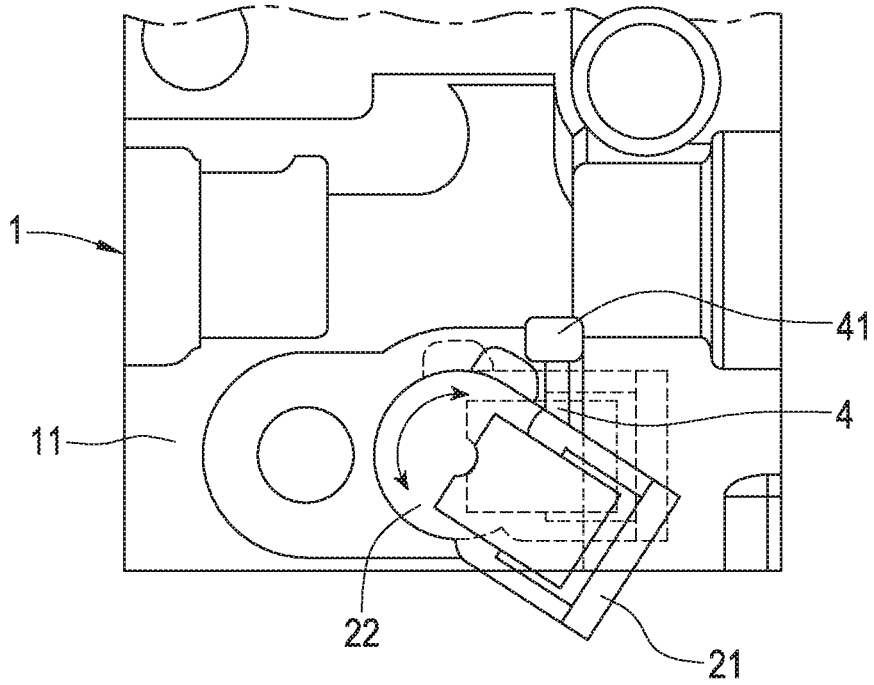
FIG. 3 is a detailed view showing a process for attaching and removing the solenoid valve shown in FIG. 1 to and from a carburetor unit.
Figure 4:
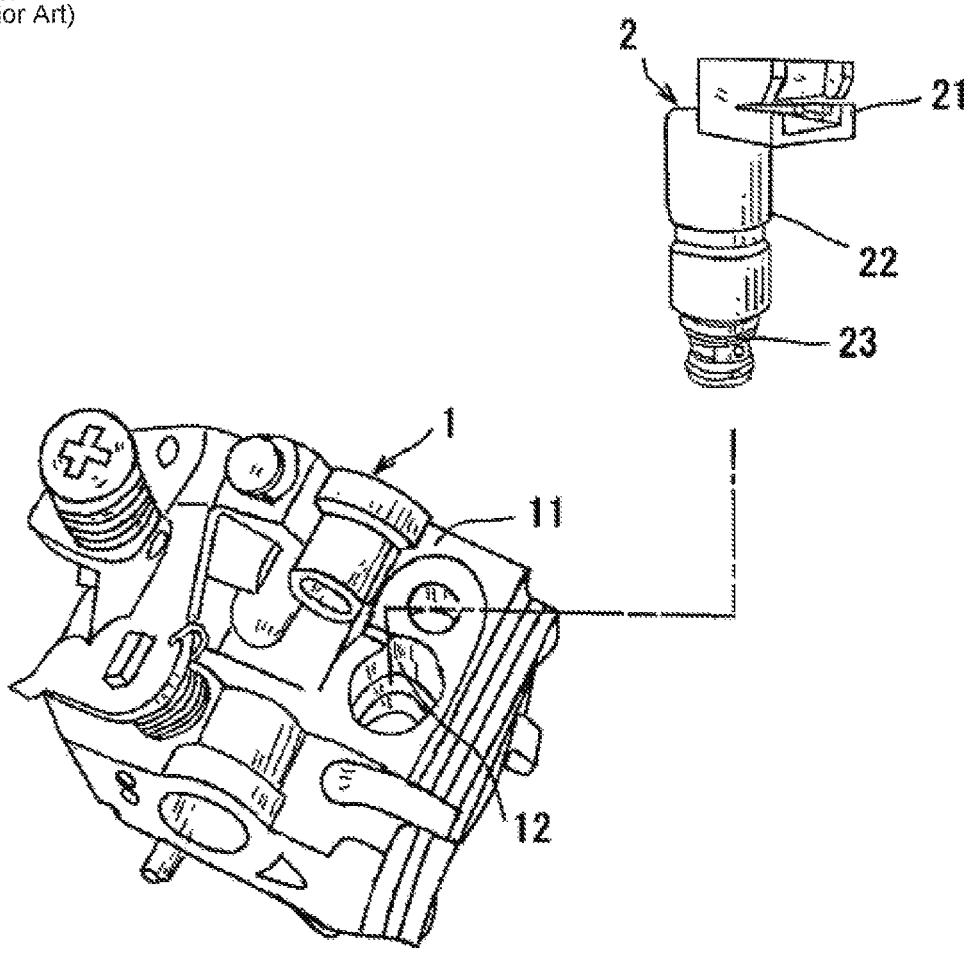
FIG. 4 (Prior Art)
FIG. 4 is an oblique view of a conventional solenoid valve and a carburetor unit in which the solenoid valve is used.
Figure 5:
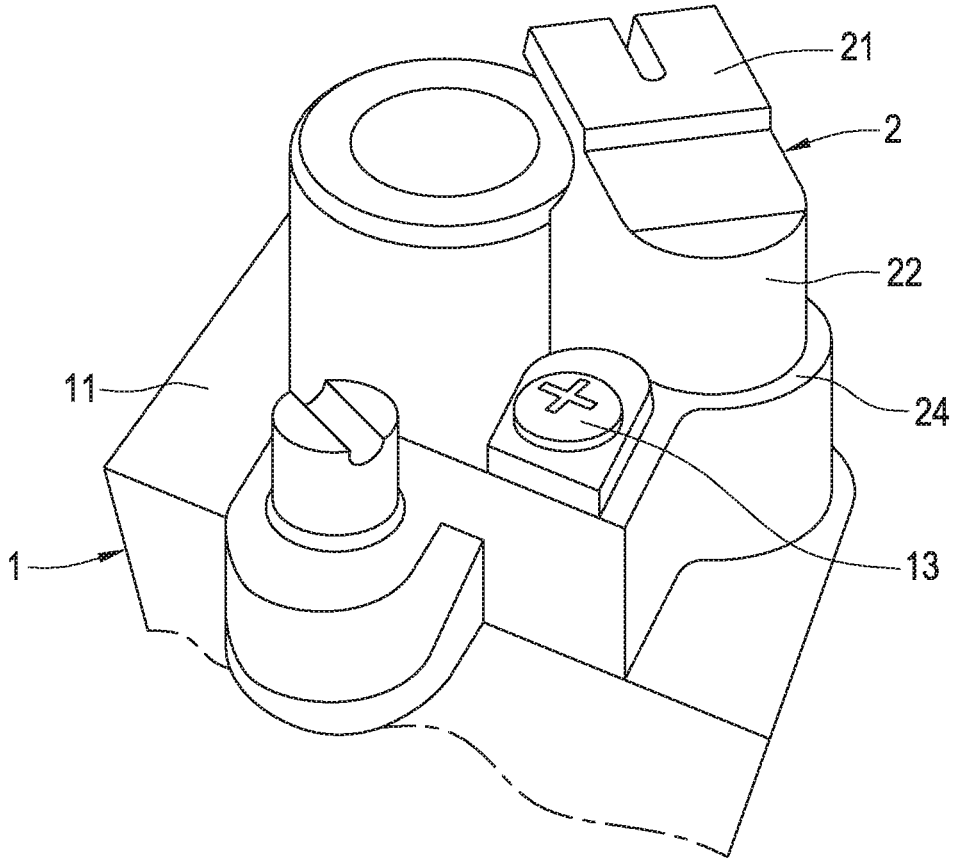
FIG. 5 (Prior Art)
FIG. 5 is a detailed view showing a conventional solenoid valve attached to a carburetor unit.
Figure 6:
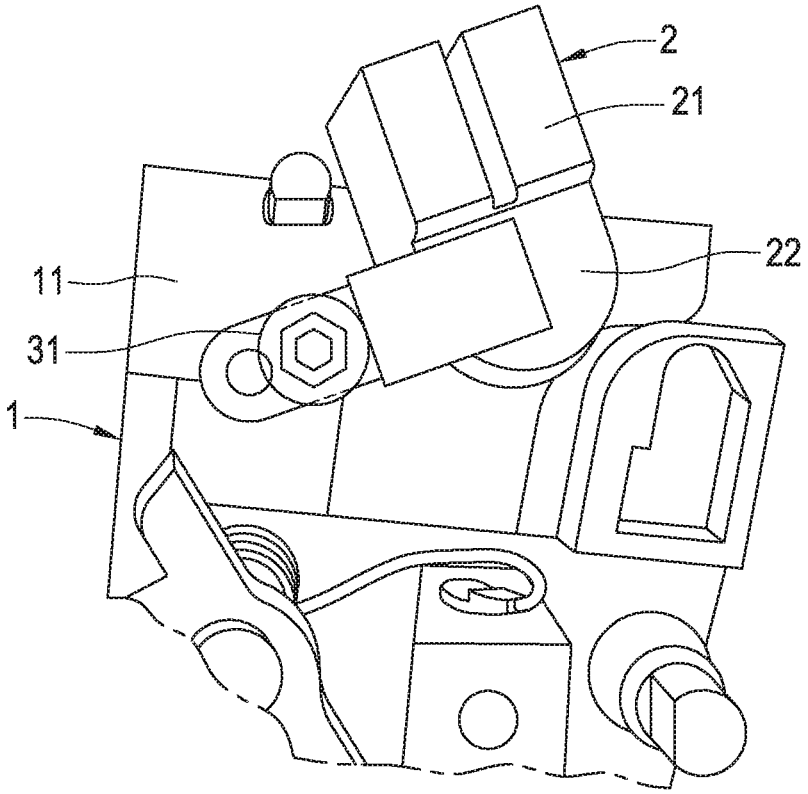
FIG. 6 (Prior Art)
FIG. 6 is a detailed view showing a conventional solenoid valve attached in a different manner to a carburetor unit.

Note that it is also possible to remove the solenoid valve 2 simply by rotating it in the opposite direction from the attachment position, as shown in FIG. 3.

All features, elements, components, functions, and steps described with respect to any embodiment provided herein are intended to be freely combinable and substitutable with those from any other embodiment. If a certain feature, element, component, function, or step is described with respect to only one embodiment, then it should be understood that that feature, element, component, function, or step can be used with every other embodiment described herein unless explicitly stated otherwise. This paragraph therefore serves as antecedent basis and written support for the introduction of claims, at any time, that combine features, elements, components, functions, and steps from different embodiments, or that substitute features, elements, components, functions, and steps from one embodiment with those of another, even if the following description does not explicitly state, in a particular instance, that such combinations or substitutions are possible. Express recitation of every possible combination and substitution is overly burdensome, especially given that the permissibility of each and every such combination and substitution will be readily recognized by those of ordinary skill in the art upon reading this description.

In many instances entities are described herein as being coupled to other entities. It should be understood that the terms "coupled" and "connected" (or any of their forms) are used interchangeably herein and, in both cases, are generic to the direct coupling of two entities (without any non-negligible (e.g., parasitic) intervening entities) and the indirect coupling of two entities (with one or more non-negligible intervening entities). Where entities are shown as being directly coupled together, or described as coupled together without description of any intervening entity, it should be understood that those entities can be indirectly coupled together as well unless the context clearly dictates otherwise.

While the embodiments are susceptible to various modifications and alternative forms, specific examples thereof have been shown in the drawings and are herein described in detail. It should be understood, however, that these embodiments are not to be limited to the particular form disclosed, but to the contrary, these embodiments are to cover all modifications, equivalents, and alternatives falling within the spirit of the disclosure. Furthermore, any features, functions, steps, or elements of the embodiments may be recited in or added to the claims, as well as negative limitations that define the inventive scope of the claims by features, functions, steps, or elements that are not within that scope.

KEY

1 Carburetor unit
2 Solenoid valve

4 Rod-like supporting portion
5 Engaging portion
11 Surface
21 Connector
22 Cover
23 Tip (insertion portion)
51 Groove-like engagement portion

The invention claimed is:

1. A carburetor comprising a body, a solenoid valve insertable into an opening formed on a surface of the body and communicating with a fuel path, a rod-like supporting portion disposed at a predetermined distance away from a surface of the body and extending in a direction substantially perpendicular to a direction of and installed near an opening in the surface of the body, and a cylindrical engaging portion extending in a direction substantially perpendicular to the axial line along which the rod-like supporting portion extends, the cylindrical engaging portion extends from an outer circumferential face of a cylindrical cover which is fitted over a main valve unit of the solenoid valve so as to expose an insertion portion in the axial line direction, the engaging portion releasably coupling the rod-like supporting portion when the insertion portion of the solenoid valve is inserted into the opening in the carburetor unit.

2. The carburetor of claim 1, wherein the engaging portion includes a groove-like engagement portion, which is narrower than the diameter of the rod-like supporting portion.

3. The carburetor of claim 1, wherein at least one of the engaging portion or the rod-like supporting portion is formed from a suitably elastic hard material.

4. The carburetor of claim 2, wherein at least one of the engaging portion or the rod-like supporting portion is formed from a suitably elastic hard material.

5. The carburetor of claim 2, wherein the groove-like engagement portion of the engaging portion is formed substantially perpendicularly to the axial line direction of the cylindrical cover.

6. The carburetor of claim 3, wherein the engaging portion includes a groove-like engagement portion formed substantially perpendicularly to the axial line direction of the cover.

7. The carburetor of claim 1, wherein the body is a molded aluminum die cast product, a molded resin product, or another type of molded product, and a holding portion which holds both ends of the rod-like supporting portion a predetermined distance away from the surface is formed integrally with the carburetor unit.

8. The carburetor of claim 1, wherein the rod-like supporting portion is formed so as to be longer than the engaging portion by at least a predetermined length, and the engaging portion and the supporting portion can be rotated in the axial direction relative to one another and inserted or removed, by rotating around the axial center with the insertion portion inserted into the opening.

9. An attachment structure for a solenoid valve which can be attached to and removed from a carburetor unit, the solenoid valve being insertable into an opening formed on a surface of the carburetor unit and communicating with a fuel path, comprising a rod-like supporting portion disposed at a predetermined distance away from a surface of a carburetor unit and extending in a direction substantially perpendicular to an axial direction of and installed near an opening in the surface of the carburetor unit, and a cylindrical engaging portion extending from the solenoid valve in a direction substantially perpendicular to an axial direction of the opening in the surface of the carburetor unit, the engaging portion releasably coupling the rod-like supporting portion when an insertion portion of the solenoid valve is inserted into the opening in the carburetor unit.

10. The attachment structure for a solenoid of claim 9, wherein the rod-like supporting portion comprising an elongate rod.

11. The attachment structure for a solenoid of claim 10, wherein the cylindrical engaging portion extends from an outer circumferential face of a cylindrical cover fitted over a main valve unit of the solenoid valve so as to axially expose the insertion portion.

12. The attachment structure for a solenoid of claim 10, wherein the engaging portion includes a groove-like engagement portion, which is narrower than the diameter than the diameter of the elongate rod.

13. The attachment structure for a solenoid valve of claim 9, wherein at least one of the engaging portion or the rod-like supporting portion is formed from a suitably elastic hard material.

14. The attachment structure for a solenoid valve of claim 12, wherein at least one of the engaging portion or the rod-like supporting portion is formed from a suitably elastic hard material.

15. The attachment structure for a solenoid valve of claim 11, wherein the engaging portion includes a groove-like engagement portion formed substantially perpendicularly to the axial direction of the cylindrical cover.

16. The attachment structure for a solenoid valve of claim 12, wherein the groove-like engagement portion of the engaging portion is formed substantially perpendicularly to the axial direction of the opening in the surface of the carburetor unit.

17. The attachment structure for a solenoid valve of claim 9, wherein the carburetor unit is a molded aluminum die cast product, a molded resin product, or another type of molded product, and a holding portion which holds both ends of the rod-like supporting portion a predetermined distance away from the surface is formed integrally with the carburetor unit.

18. The attachment structure for a solenoid valve of claim 9, wherein the rod-like supporting portion is formed so as to be longer than the engaging portion by at least a predetermined length, and the engaging portion and the rod-like supporting portion can be rotated about the axial direction of the opening in the surface of the carburetor unit releasably coupling and uncoupling from one another.

* * * * *